US007526224B2

(12) United States Patent
Ishii

(10) Patent No.: US 7,526,224 B2
(45) Date of Patent: Apr. 28, 2009

(54) DEVELOPING DEVICE, PROCESS CARTRIDGE, AND IMAGE FORMING APPARATUS

(75) Inventor: Masahiro Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 155 days.

(21) Appl. No.: 11/737,352

(22) Filed: Apr. 19, 2007

(65) Prior Publication Data

US 2007/0280726 A1 Dec. 6, 2007

(30) Foreign Application Priority Data

May 30, 2006 (JP) ..... 2006-150671

(51) Int. Cl.
*G03G 15/08* (2006.01)
*G03G 15/095* (2006.01)

(52) U.S. Cl. ..... 399/103; 399/273; 399/274; 399/260

(58) Field of Classification Search ..... 399/102, 399/103, 105, 274, 284
See application file for complete search history.

(56) References Cited

U.S. PATENT DOCUMENTS 6,336,014 B1 1/2002 Sato et al.
7,292,802 B2 * 11/2007 Fukuta et al. ..... 399/103

FOREIGN PATENT DOCUMENTS

| | | |
|---|---|---|
| EP | 1635226 | 3/2006 |
| JP | 2001-022179 | 1/2001 |
| JP | 2006-039429 | 2/2006 |

* cited by examiner

*Primary Examiner*—Timothy J Thompson
*Assistant Examiner*—Gregory H Curran
(74) *Attorney, Agent, or Firm*—Banner & Witcoff, Ltd.

(57) ABSTRACT

Gap among a leaf spring member of a layer-thickness regulating blade, a back-side member of a blade holder and a blade opposed portion of an upper seal is filled with grease. An internal seal is disposed laterally inward of the grease with a portion thereof sandwiched between the back surface of the leaf spring member and the blade opposed portion of the upper seal. This can prevent the grease from overflowing laterally inward from the gap among the back-side member, the leaf spring member and the upper seal, and can also prevent a toner from entering into a gap among the back-side member, the leaf spring member and the upper seal, thereby preventing the oil content of the grease from mixing into the toner.

8 Claims, 8 Drawing Sheets

DEVELOPING DEVICE, PROCESS CARTRIDGE, AND IMAGE FORMING APPARATUS

CROSS REFERENCE TO RELATED APPLICATIONS

This application claims the benefit of Japanese Patent Application No. 2006-150671, filed on May 30, 2006, the disclosure of which is incorporated herein by reference.

TECHNICAL FIELD

The present invention relates to a developing device, a process cartridge, and an image forming apparatus.

BACKGROUND

In the image forming apparatus such as a laser printer, an electrostatic latent image is formed on the surface of a photosensitive drum. The electrostatic latent image is fed with a toner from a developing device and a toner image is carried on the surface of the photosensitive drum. The toner image is then transferred to a sheet to achieve image formation on the sheet.

The developing device includes a casing having an opening opened to the photosensitive drum, a developing roller for carrying a toner accommodated in this casing, and a blade for restricting a layer thickness of the toner carried on the developing roller. The developing roller is rotatably supported at the opening of the casing with a part of the surface thereof exposed from the opening. The blade is formed in thin plate extending along the axial direction of the developing roller. The upper end portion of the blade is supported on the casing via the blade holder, and the lower end portion of the blade is in press contact with the surface of the developing roller. The toner in the casing is fed on the surface of the developing roller. Along with the rotation of the developing roller, the toner on the surface of the developing roller passes between the blade and the surfaces of the developing roller to form a thin layer having a constant thickness. The toner on the surface of the developing roller is fed to an electrostatic latent image formed on the surface of the photosensitive drum when contacting with the surface of the photosensitive drum.

In such a developing device, the toner may flow around onto the rear surface of the blade (opposite side of the opposed surface to the developing roller) and leak out upward from the interface between the blade holder and the casing. To avoid this, an upper seal for preventing the toner leakage from the interface therebetween is provided between the blade holder and the casing.

The upper seal extends, for example, in the longitudinal direction of the blade, and formed in such a width (length in the direction orthogonal to the longitudinal direction) that the both end portions thereof in the longitudinal direction extend across and contact the rear surface of the blade and the rear surface (opposed surface to the casing) of the blade holder. However, when the upper seal is formed in the width described above, since the rear surface of the blade and the rear surface (opposed surface to the casing) of the blade holder have a step, and the step causes a gap between the upper seal and the rear surface of the blade, the toner may leak out from the gap.

To avoid this, grease is coated on a region opposed to the both end portions of the upper seal on the rear surface of the blade. Accordingly, when the blade is attached to the casing, the grease is pressed by the upper seal and fills the gap between the upper seal and the rear surface of the blade.

However, when the grease overflows inward in the longitudinal direction from the gap between the upper seal and the rear surface of the blade, the oil content from the overflowed grease mixes with the toner. As a result, the image forming process may be adversely affected in the case where the toner mixed with the oil content of the grease adheres to the developing roller.

SUMMARY

One aspect of the present invention may provide a developing device, a process cartridge, and an image forming apparatus which can prevent the mixture of oil content of oil fillers such as grease and the like into the developing agent.

One aspect of the present invention may provide a developing device including: a casing formed with an elongated opening and having a wall portion along one end edge extending in a longitudinal direction of the opening; a developing agent carrier member for carrying a developing agent on a circumferential surface, disposed so as to expose one portion of the circumferential surface from the opening and provided rotatably about an axis extending in the longitudinal direction; a layer-thickness regulating member for restricting a layer thickness of the developing agent carried on the circumferential surface, formed in a thin plate shape extending in the longitudinal direction and having one distal end portion on one end side in a direction orthogonal to the longitudinal direction for pressing the circumferential surface of the developing agent carrier member; a holding member for holding a proximal end portion on the opposite side of the distal end portion of the layer-thickness regulating member, disposed in an opposed relation to the wall portion; a first seal member for sealing between the wall portion and the holding member, which extends in the longitudinal direction, each of whose both end portions in the longitudinal direction is sandwiched between the wall portion and the holding member and between the wall portion and the layer-thickness regulating member, and in which a central portion between the both end portions is sandwiched at least between the wall portion and the holding member; an oil filler for filling the gap, disposed in a gap formed among the layer-thickness regulating member, the holding member and each of the both end portions of the first seal member; and a second seal member provided partially in a region inward in the longitudinal direction with respect to the oil filler on a opposed surface of the layer-thickness regulating member to the first seal member with at least a portion thereof disposed in a state of being sandwiched between the layer-thickness regulating member and the first seal member.

The same or different aspect of the present invention may provide a processing cartridge being detachably attachable to an image forming apparatus and including: a developing device; and an image carrier member fed with a developing agent from the developing device, wherein the developing device comprises: a casing formed with an elongated opening and having a wall portion along one end edge extending in a longitudinal direction of the opening; a developing agent carrier member for carrying a developing agent on a circumferential surface, disposed so as to expose one portion of the circumferential surface from the opening and provided rotatably about an axis extending in the longitudinal direction; a layer-thickness regulating member for restricting a layer thickness of the developing agent carried on the circumferential surface, formed in a thin plate shape extending in the longitudinal direction and having one distal end portion on one end side in a direction orthogonal to the longitudinal direction for pressing the circumferential surface of the developing agent carrier member; a holding member for holding a proximal end portion on the opposite side of the distal end portion of the layer-thickness regulating member, disposed in an opposed relation to the wall portion; a first seal member for sealing between the wall portion and the holding member, which extends in the longitudinal direction, each of whose both end portions in the longitudinal direction is sandwiched between the wall portion and the holding member and between the wall portion and the layer-thickness regulating member, and in which a central portion between the both end portions is sandwiched at least between the wall portion and the holding member; an oil filler for filling the gap, disposed in a gap formed among the layer-thickness regulating member, the holding member and each of the both end portions of the first seal member; and a second seal member provided partially in a region inward in the longitudinal direction with respect to the oil filler on a opposed surface of the layer-thickness regulating member to the first seal member with at least a portion thereof disposed in a state of being sandwiched between the layer-thickness regulating member and the first seal member.

One or more aspects of the present invention provide an image forming apparatus including: a developing device; and an image carrier member fed with a developing agent from the developing device, wherein the developing device comprises: a casing formed with an elongated opening and having a wall portion along one end edge extending in a longitudinal direction of the opening; a developing agent carrier member for carrying a developing agent on a circumferential surface, disposed so as to expose one portion of the circumferential surface from the opening and provided rotatably about an axis extending in the longitudinal direction; a layer-thickness regulating member for restricting a layer thickness of the developing agent carried on the circumferential surface, formed in a thin plate shape extending in the longitudinal direction and having one distal end portion on one end side in a direction orthogonal to the longitudinal direction for pressing the circumferential surface of the developing agent carrier member; a holding member for holding a proximal end portion on the opposite side of the distal end portion of the layer-thickness regulating member, disposed in an opposed relation to the wall portion; a first seal member for sealing between the wall portion and the holding member, which extends in the longitudinal direction, each of whose both end portions in the longitudinal direction is sandwiched between the wall portion and the holding member and between the wall portion and the layer-thickness regulating member, and in which a central portion between the both end portions is sandwiched at least between the wall portion and the holding member; an oil filler for filling the gap, disposed in a gap formed among the layer-thickness regulating member, the holding member and each of the both end portions of the first seal member; and a second seal member provided partially in a region inward in the longitudinal direction with respect to the oil filler on a opposed surface of the layer-thickness regulating member to the first seal member with at least a portion thereof disposed in a state of being sandwiched between the layer-thickness regulating member and the first seal member.

DETAILED DESCRIPTION

1. Overall Configuration of Laser Printer

Figure 1:
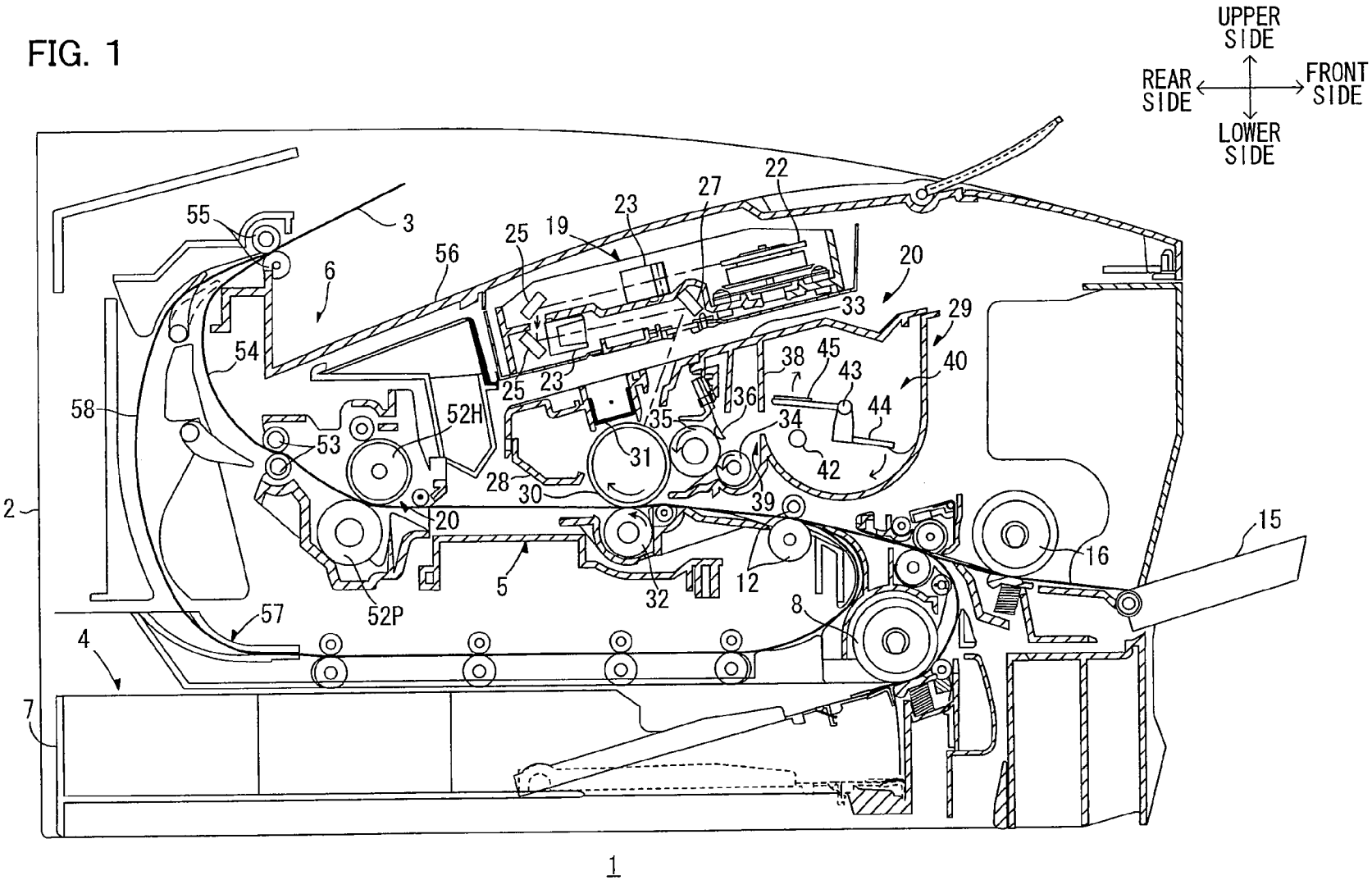
FIG. 1 is a sectional side view of a main portion (sectional view taken along a vertical plane along an anteroposterior direction) showing illustrative aspects of a laser printer as an example of an image forming apparatus according to one or more aspects of the present invention.

FIG. 1 is a sectional side view of a main portion (sectional view taken along a vertical plane along an anteroposterior direction) showing illustrative aspects of a laser printer as an example of an image forming apparatus according to one or more aspects of the present invention.

This laser printer 1 includes in a main body casing 2 a sheet feeding section 4 for feeding a sheet 3, an image forming section 5 for forming an image on the fed sheet 3, and a sheet ejecting section 6 for ejecting the sheet 3 formed with an image in the image formation section 5 from the main body casing 2.

In this laser printer 1, the side on which a multipurpose tray 15 (described later) is provided will be hereinafter referred to as a "front side", and the side on which an ejecting roller 55 (described later) is provided will be hereinafter referred to as a "rear side". The anteroposterior and up-and-down directions of a drum cartridge 28 and a developer cartridge 29 are defined in a state where they are attached in the main body casing 2.

(1) Sheet Feeding Section

The sheet feeding section 4 includes a sheet feeding tray 7 which is detachably attached along the anteroposterior direction on the bottom of the main body casing 2. The sheet feeding tray 7 accommodates the sheet 3 in a stacked state. A sheet feeding roller 8 is disposed above the front end portion of the sheet feeding tray 7. When this sheet feeding roller 8 is rotated, the sheet 3 accommodated in the sheet feeding tray 7 is fed one by one from the sheet feeding tray 7.

This sheet feeding section 4 includes the multipurpose tray 15 used for manual sheet feeding and other purposes, and a multipurpose-side sheet feeding roller 16 for feeding the sheet 3 stacked on the multipurpose tray 15. The sheets 3 are placed on the multipurpose tray 15 in a stacked state. When the multipurpose-side sheet feeding roller 16 is rotated, the sheet 3 stacked on the multipurpose tray 15 is fed one by one from the multipurpose tray 15.

The sheet 3 fed from the sheet feeding tray 7 or the multipurpose tray 15 is transported to a resist roller 12. The resist roller 12 resists the sheet 3 and then transports the sheet 3 to a transfer position of the image forming section 5 (between a photosensitive drum 30 and a transfer roller 32, which are described later).

(2) Image Forming Section

The image forming section 5 includes a scanning unit 19, a process unit 20 as one example of the process cartridge, and a fixing section 21.

(2-1) Scanning Unit

The scanning unit 19 is provided in the upper portion of the main body casing 2. The scanning unit 19 includes a laser (not shown), a polygonal mirror 22, lenses 23 and 24, and reflecting mirrors 25, 26, and 27 and the like.

The laser emits a laser beam based on the image data, and the laser beam passes through or is reflected on the polygonal mirror 22, the lens 23, the reflecting mirrors 25 and 26, the lens 24, and the reflecting mirror 27 in this order as indicated by a chain line, and then irradiated by high-speed scanning on the surface of the photosensitive drum 30 (described later) of the processing unit 20.

(2-2) Processing Unit

Figure 2:
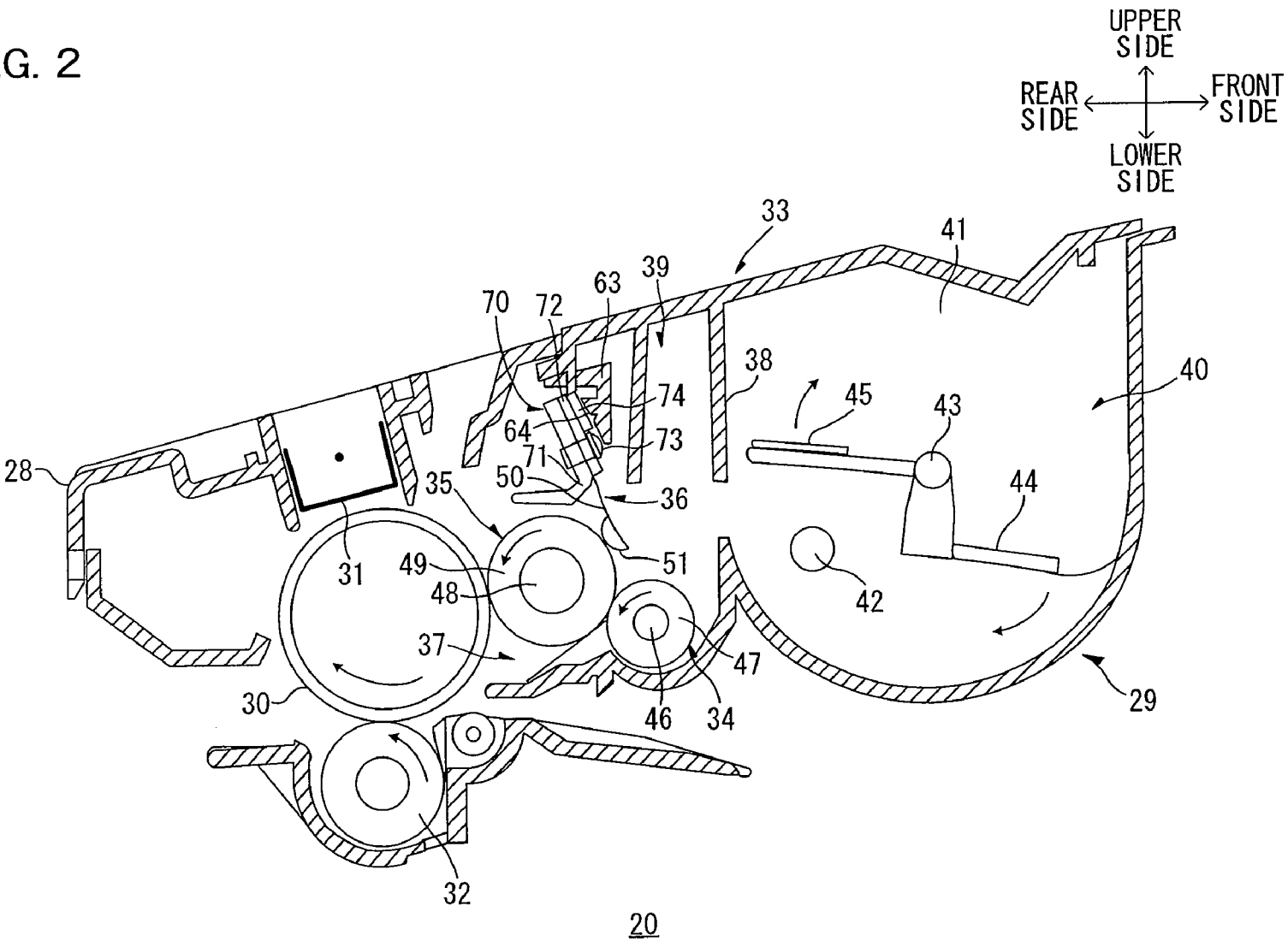
FIG. 2 is a sectional side view of a main portion of a processing unit shown in FIG. 1.

FIG. 2 is a sectional side view of a main portion of the processing unit 20.

The processing unit 20 is detachably attached to the main body casing 2 below the scanning unit 19 in the main body casing 2.

The processing unit 20 includes the drum cartridge 28 which is detachably attached to the main body casing 2. The drum cartridge 28 includes the developer cartridge 29 as one example of the developing device, the photosensitive drum 30 as one example of the image carrier member, a scorotron charger 31, and the transfer roller 32.

The developer cartridge 29 is detachably attached to the drum cartridge 28. The developer cartridge 29 includes a casing 33. The developer cartridge 29 includes in the casing 33 a feed roller 34, a developing roller 35 as one example of the developing agent carrier member, and a layer-thickness regulating blade 36 as one example of the layer-thickness regulating member.

The casing 33 is formed in a box shape having an opening 37 in the rear side thereof as shown in FIG. 2. The opening 37 is formed in a rectangular shape extending in the width (lateral) direction (direction orthogonal to the anteroposterior and up-and-down directions).

The casing 33 is formed with a partition plate 38 in the mid portion thereof in an anteroposterior direction. The partition plate 38 partitions the casing 33 into a developing chamber 39 on the rear side and a toner accommodation chamber 40 on the front side. The developing chamber 39 and the toner accommodation chamber 40 are communicated with each other in the lower portion of the partition plate 38.

In the casing 33, windows 42 for toner-empty detection are provided in an opposed relation to each other with the toner accommodation chamber 40 sandwiched therebetween and on the front sides of respective opposite side walls 41 which are disposed in an opposed spaced relation to each other in the width direction.

In the toner accommodation chamber 40, a positively chargeable non-magnetic single-component toner is accommodated as a developing agent.

Moreover, in the toner accommodation chamber 40, a rotation shaft 43 is provided extending in the width direction in the center as viewed from side. This rotation shaft 43 has both end portions rotatably supported on the both side walls 41 of the casing 33, and extends between the both side walls 41. The rotation shaft 43 is provided with an agitator 44 for agitating the toner in the toner accommodation chamber 40 and a cleaner 45 for cleaning the window 42, both extending in the radial direction.

When the rotation shaft 43 rotates in the clockwise direction in the accompanying drawings, the toner in the toner accommodation chamber 40 is agitated by the agitator 44 and discharged to the developing chamber 39 from below the partition plate 38. Along with the rotation of the rotation shaft 43, the cleaner 45 cleans the window 42.

In the developing chamber 39, the feed roller 34 is disposed at the position obliquely rearward below the opening below the partition plate 38. This feed roller 34 includes a metallic roller shaft 46, and a sponge roller 47 formed of a conductive sponge material and covering the roller shaft 46. The roller shaft 46 has both end portions rotatably supported on the both side walls 41 of the casing 33.

The developing roller 35 is opposed to the feed roller 34 and is obliquely rearward above the feed roller 34 in the developing chamber 39. Moreover, the developing roller 35 has a portion exposed from the opening 37 of the casing 33. The developing roller 35 includes a metallic roller shaft 48, and a rubber roller 49 formed of a conductive rubber material and covering the roller shaft 48. The roller shaft 48 has both end portions rotatably supported on the both side walls 41 of the casing 33.

The feed roller 34 and the developing roller 35 are brought into abutment against each other so that the sponge roller 47 and the rubber roller 49 are compressed to a certain degree. At the time of image formation (image developing), both the feed roller 34 and the developing roller 35 are rotated in the clockwise direction in the accompanying drawings so that the sponge roller 47 and the rubber roller 49 rub against each other. At the same time, the developing roller 35 is applied with a developing bias.

The layer-thickness regulating blade 36 is disposed above the front side of the developing roller 35 in the developing chamber 39. The layer-thickness regulating blade 36 includes a leaf spring member 50 formed in a thin plate, and a press contact portion 51 provided in the lower end portion of the leaf spring member 50. The elastic force of the leaf spring member 50 causes the press contact portion 51 to press obliquely the circumferential surface of the sponge roller 47 of the developing roller 35 from the upper front side. The layer-thickness regulating blade 36 will be described later in detail.

The toner fed from the toner accommodation chamber 40 to the developing chamber 39 is fed to the developing roller 35 by the rotation of the feed roller 34. At this time, the toner is triboelectrically positively charged between the feed roller 34 (sponge roller 47) and the developing roller 35 (rubber roller 49). The positively charged toner on the developing roller 35 enters between the press contact portion 51 of the layer-thickness regulating blade 36 and the developing roller 35 by the rotation of the developing roller 35. Accordingly, the layer thickness of the positively charged toner is restricted between the press contact portion 51 and the developing roller 35 and the positively charged toner is carried on the circumferential surface of the developing roller 35 as a thin layer.

The photosensitive drum 30 is disposed in an opposed relation to the developing roller 35 in the rear side of the developing roller 35. The photosensitive drum 30 is provided rotatably in the arrow direction (clockwise direction). In addition, this photosensitive drum 30 is grounded and the outermost layer thereof is formed by a positively chargeable photosensitive layer formed of polycarbonate or the like.

The scorotron charger 31 is disposed in a spaced relation to and above the photosensitive drum 30. This scorotron charger 31 is for positively charging and generates corona discharge from a wire of tungsten and the like. The scorotron charger 31 positively and uniformly charges the surface of the photosensitive drum 30.

The surface of the photosensitive drum 30 is positively and uniformly charged by the scorotron charger 31 when the photosensitive drum 30 rotates, and then exposed to light by high-speed scanning of the laser beams from the scanning unit 19 to form an electrostatic latent image based on the image data.

Thereafter, by the rotation of the developing roller 35, the toner which is carried on the surface of the developing roller 35 contacts the photosensitive drum 30 in an opposed relation. At this time, the toner is fed to and selectively carried on the electrostatic latent image formed on the surface of the photosensitive drum 30, that is, a portion exposed to light by laser beams and has a lower potential on the surface of the uniformly positively charged photosensitive drum 30. As a result, reversal developing is achieved and the toner image as a developing agent image is carried on the surface of the photosensitive drum 30.

The transfer roller 32 is disposed above and in an opposed relation to the photosensitive drum 30. The transfer roller 32 is provided rotatably in the arrow direction (counterclockwise direction). This transfer roller 32 includes a metallic roller shaft, and a rubber roller formed of a conductive rubber material and covering the roller shaft. The transfer roller 32 is applied with a transfer bias at the time of transfer.

The toner image carried on the surface of the photosensitive drum 30 is transferred onto the sheet 3 transported from the resist roller 12 while the sheet 3 passes between the photosensitive drum 30 and the transfer roller 32 (transfer position).

In this laser printer 1, the remaining toner that remains on the surface of the photosensitive drum 30 after the toner has been transferred to the sheet 3 by the transfer roller 32 is recovered by the developing roller 35. That is, in the laser printer 1, the remaining toner is recovered by a so-called cleaner-less system.

(2-3) Fixing Section

The fixing section 21 is provided in back of the processing unit 20 as shown in FIG. 1. The fixing section 21 includes a heating roller 52H, a pressure roller 52P, and a pair of transport rollers 53. The pressure roller 52P is disposed in an opposed relation to the heating roller 52H so as to press the heating roller 52H from below.

The sheet 3 passes between the heating roller 52H and the pressure roller 52P, and during this the toner that has been transferred to the sheet 3 is thermally fixed to the sheet 3. Afterwards, the sheet 3 is transported to the sheet ejecting section 6 by a couple of transport rollers 53.

(3) Sheet Ejecting Section

The sheet ejecting section 6 includes a sheet ejecting path 54, the sheet ejecting roller 55 provided on the downstream side end portion of the sheet ejecting path 54, and a sheet ejection tray 56 receiving the sheet 3 ejected from the sheet ejecting roller 55.

The sheet 3 transported from the fixing section 21 to the sheet ejecting path 54 is ejected on the sheet ejection tray 56 by the sheet ejecting roller 55.

(4) Reversal Transport Section

This laser printer 1 includes a reversal transport portion 57 for forming images on the both sides of the sheet 3. This reversal transport portion 57 includes a reversal transport path 58.

To form images on the both sides of the sheet 3, the sheet 3 formed with an image on one surface thereof passes through the reversal transport path 58 and transported to the resist roller 12 in a reversed manner. The sheet 3 now formed with images on the both sides thereof is transported through the sheet ejecting path 54 and ejected on the sheet ejection tray 56 by the sheet ejecting roller 55.

2. Configuration of Main Portions of Developer Cartridge (1) Casing

Figure 3:
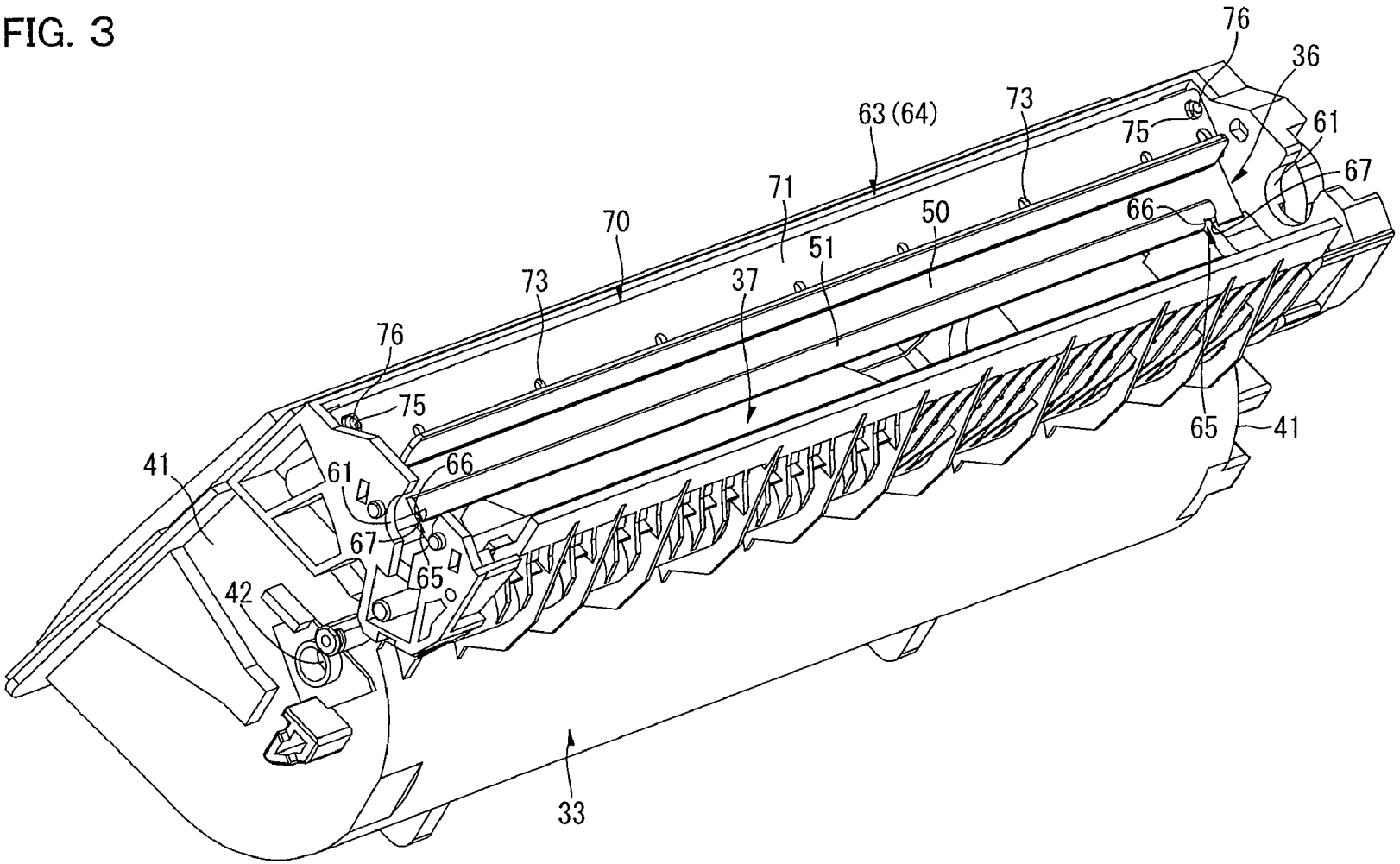
FIG. 3 is a perspective view of a casing of a developer cartridge shown in FIG. 2 as seen obliquely from the lower rear side.
Figure 4:
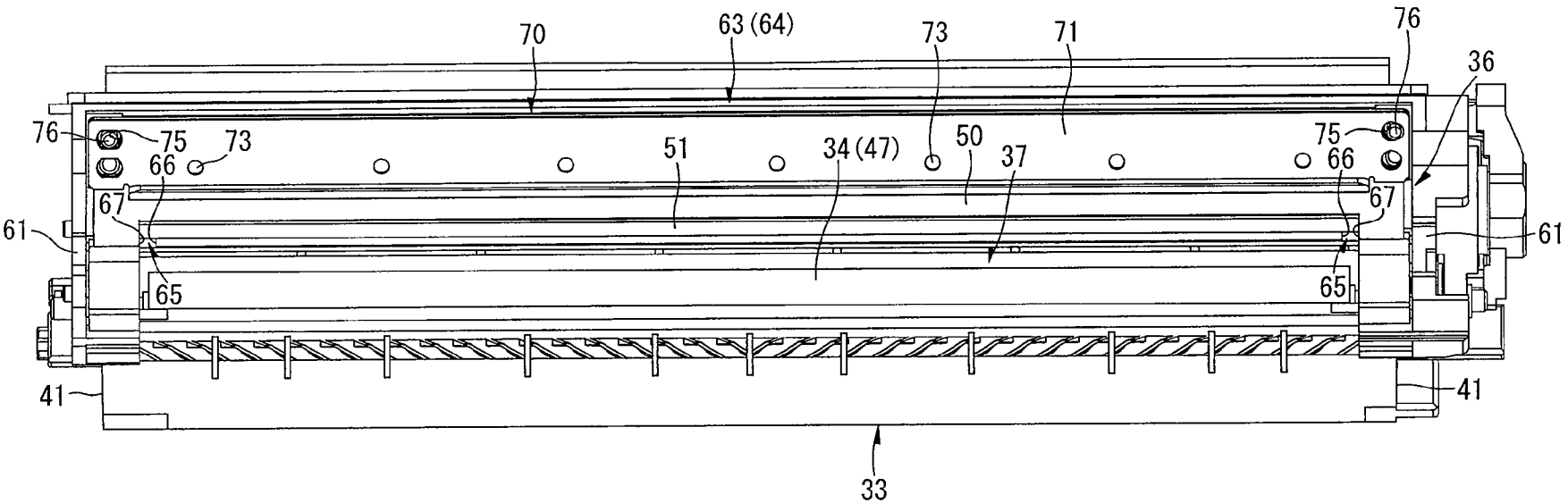
FIG. 4 is a rear elevational view of the casing shown in FIG. 3.

FIG. 3 is a perspective view of the casing 33 of the developer cartridge 29 as seen obliquely from the lower rear side. FIG. 4 is a rear elevational view of the casing shown in FIG. 3.

As described above, the casing 33 is formed in a box shape having the opening 37 in the rear side thereof. This casing 33 is formed with the shaft supporting grooves 61 for receiving the both end portions of the roller shaft 46 of the feed roller 34 and the both end portions of the roller shaft 48 (see FIG. 2) of the developing roller 35 on the both side walls 41 which sandwich the opening 37 therebetween in the width direction. The casing 33 is formed with a mounting wall 63 as one example of a wall portion, along the upper end edge of the opening 37. This mounting wall 63 is formed so that a rear surface 64 thereof inclines from the upper rear side to the lower front side, as shown in FIG. 2.

(3) Layer-thickness Regulating Blade

The layer-thickness regulating blade 36 includes the leaf spring member 50 formed in a thin plate, and the press contact portion 51 provided in the lower end portion of the leaf spring member 50, as mentioned above.

The leaf spring member 50 is formed of a metal thin plate and formed in a generally elongated rectangular shape as seen from back extending along the width direction.

This leaf spring member 50 has the notched portions 65 which is cut out in a rectangular shape from the lower end edge toward the upper end edge, in the vicinity of the both respective lateral end portions of the lower end portion thereof. Each notched portion 65 has an internal end edge 66 in the width direction (longitudinal direction of the leaf spring member 50) which locates laterally outward of a passage region of the sheet 3 of the maximum size available for this laser printer 1. An external end edge 67 is formed in a spaced relation at a predetermined interval (2.7 mm, for example) laterally outward from the internal end edge 66 thereof.

The press contact portion 51 is formed of elastic rubber such as a silicone rubber or the like. The press contact portion 51 extends along the width direction in the lower end portion of the leaf spring member 50 and formed as a ridged projecting backward.

(3) Blade Holder

The layer-thickness regulating blade 36 is held by a blade holder 70 as one example of the holding member and mounted to the rear surface 64 of the mounting wall 63 of the casing 33.

Figure 5:
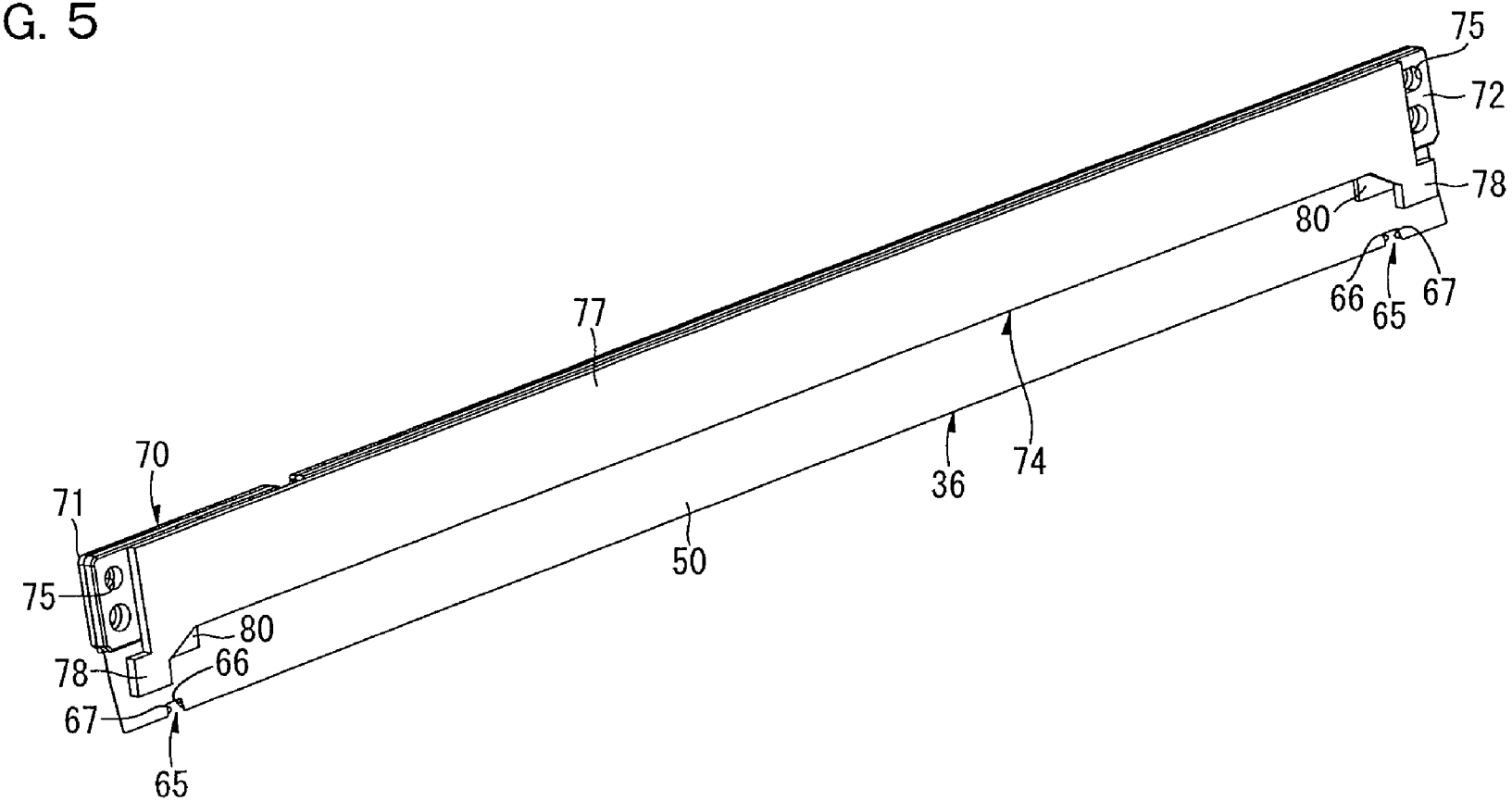
FIG. 5 is a perspective view of a layer-thickness regulating blade and a blade holder shown in FIG. 3.
Figure 6:
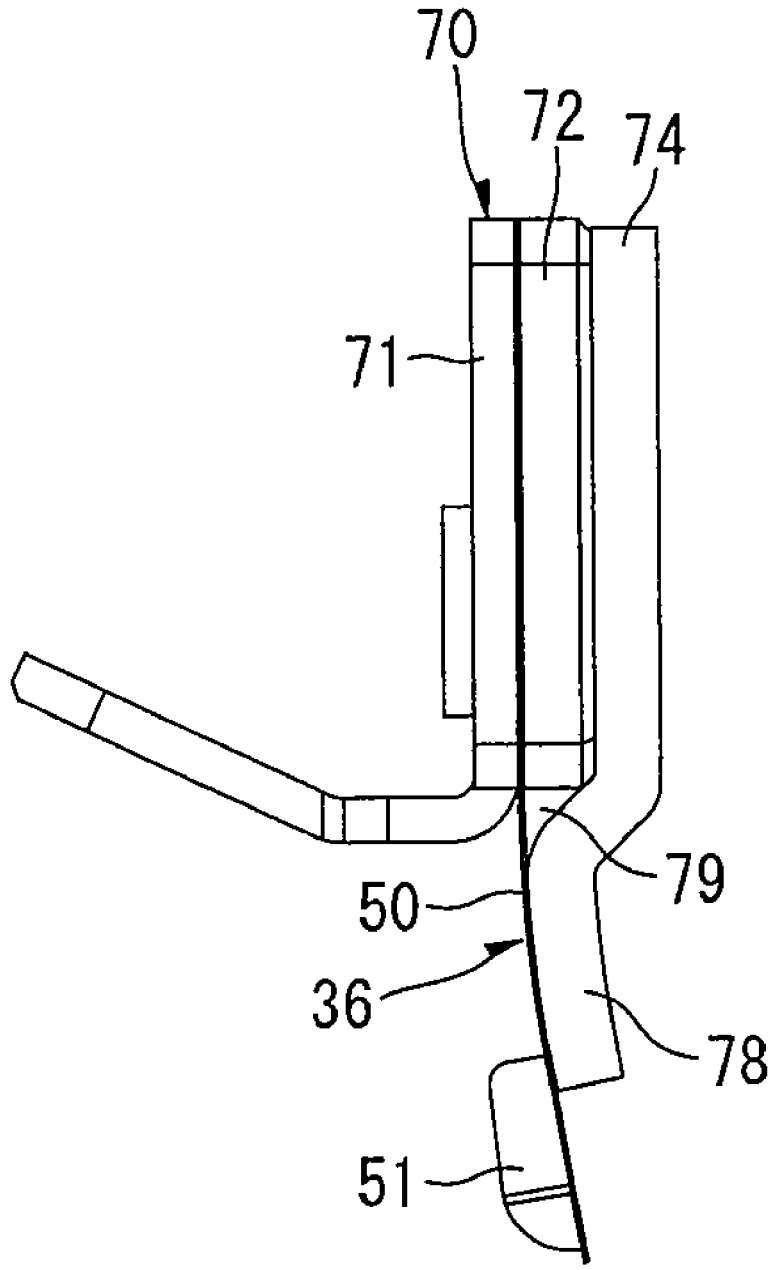
FIG. 6 is a side view of the layer-thickness regulating blade and the blade holder shown in FIG. 5.

FIG. 5 is a perspective view of the layer-thickness regulating blade 36 and the blade holder 70. FIG. 6 is a side view of the layer-thickness regulating blade 36 and the blade holder 70.

The blade holder 70 includes a front-side member 71 formed of a steel sheet in a generally L-shape in cross section extending along the width direction and a back-side member 72 formed of a steel sheet in a flat shape extending along the width direction. The front-side member 71 and the back-side member 72 are formed to have a width generally equal to that of the leaf spring member 50 of the layer-thickness regulating blade 36 in the width direction. The front-side member 71 and the back-side member 72 are disposed in an opposed relation to each other and sandwich the upper end portion of the leaf spring member 50. A plurality of screws 73 inserted through from the side of the back-side member 72 fix the leaf spring member 50, the front-side member 71 and the back-side member 72 with one another, as shown in FIG. 2. The blade holder 70 has in the both lateral end portions thereof penetration holes 75 which penetrate the front-side member 71, the layer-thickness regulating blade 36, and the back-side member 72, as shown in FIG. 5.

The blade holder 70 which holds the layer-thickness regulating blade 36 is mounted to the rear surface 64 of the mounting wall 63 of the casing 33 with an upper seal 74 sandwiched therebetween. More specifically, the upper seal 74 is adhered to the rear surface 64 (see FIG. 3) of the mounting wall 63 of the casing 33 with a double-sided adhesive tape or the like. The blade holder 70 is fixed to the mounting wall 63 of the casing 33 by fixing screws 76 inserted through the penetration holes 75 at the both lateral end portions thereof with the back-side member 72 pressed against the upper seal 74.

Though the upper seal 74 is adhered on the rear surface 64 of the mounting wall 63 of the casing 33, as described above, the upper seal 74 is illustrated, for convenience, together with the layer-thickness regulating blade 36 and the blade holder 70 in FIG. 5.

(4) Upper Seal

The upper seal 74 as one example of the first seal member is formed of sponge material such as urethane sponge and the like. The upper seal 74 integrally includes a holder opposed portion 77 formed in a generally rectangular shape as seen from front extending in the width direction, and blade opposed portions 78 extending downward from the respective lower end edges of the both lateral end portions of this holder opposed portion 77.

The holder opposed portion 77 is opposed to the back-side member 72 of the blade holder 70 and is sandwiched between the mounting walls 63 of the casing 33 and this back-side member 72. This holder opposed portion 77 is formed to have the length in the width direction slightly shorter than that of the back-side member 72 so as not to block the penetration holes 75 at the both lateral end portions of the blade holder 70. In addition, the holder opposed portion 77 is formed to have a length in a direction orthogonal to the width direction generally equal to the back-side member 72.

The blade opposed portion 78 is opposed to the lateral end portion of the leaf spring member 50 of the layer-thickness regulating blade 36, and sandwiched between the lateral end portion of the layer-thickness regulating blade 36 and the mounting walls 63 of the casing 33. The external end edge of the blade opposed portion 78 in the width direction extends downward on the line of the external end edge of the holder opposed portion 77 in the width direction, and bends laterally outward and further bends downward. On the other hand, the internal end edge of the blade opposed portion 78 in the width direction extends from the lower end edge of the holder opposed portion 77 obliquely downwardly outward in the width direction, and bends downward. In addition, the lower end edge of the blade opposed portion 78 extends in the width direction and connects the lower end of the external end edge of the blade opposed portion 78 in the width direction and the lower end of the internal end edge of the blade opposed portion 78 in the width direction.

Thus, the holder opposed portion 77 is opposed to the back-side member 72 of the blade holder 70 while the blade opposed portion 78 is opposed to the leaf spring member 50 of the layer-thickness regulating blade 36. Each of the both lateral end portions of the upper seal 74 extends across and contacts both the back-side member 72 and the leaf spring member 50. Since a step having the thickness of the back-side member 72 is formed between the back-side member 72 and the leaf spring member 50, as shown in FIG. 6, a gap is formed among the back-side member 72, the leaf spring member 50 and the upper seal 74 when each of the both lateral end portions of the upper seal 74 extends across and contact the back-side member 72 and the leaf spring member 50. To avoid this, the gap is filled with grease 79 as one example of the oil filler.

(5) Grease

Before the layer-thickness regulating blade 36 is mounted on the mounting wall 63 of the casing 33, the grease 79 is coated on a region on each of the both end portions of the back surface (opposite surface to the surface opposed to the developing roller 35) of the leaf spring member 50, and the region contacts the back-side member 72 and is opposed to a portion laterally outward of the internal end edge in the width direction extending in the up-and-down direction of the blade opposed portion 78 of the upper seal 74. The grease 79 is pressed by the upper seal 74 when the layer-thickness regulating blade 36 is mounted on the mounting wall 63 of the casing 33, and fills and seals the gap among the back-side member 72, the leaf spring member 50, and the upper seal 74.

At this time, when the grease 79 extends from the gap among the back-side member 72, the leaf spring member 50, and the upper seal 74 to the lateral inside to overflow into a region that is not opposed to the upper seal 74 on the back surface of the leaf spring member 50, the oil content overflown from the grease 79 will be mixed with the toner.

To avoid this, a part of an internal seal 80 for preventing the grease 79 from overflowing laterally inward from the gap among the back-side member 72, the leaf spring member 50, and the upper seal 74 is interposed between each of the both lateral end portions of the back surface of the leaf spring member 50 and the blade opposed portion 78 of the upper seal 74, as one example of a second seal member, as shown in FIG. 5.

(6) Internal Seal

Figure 7:
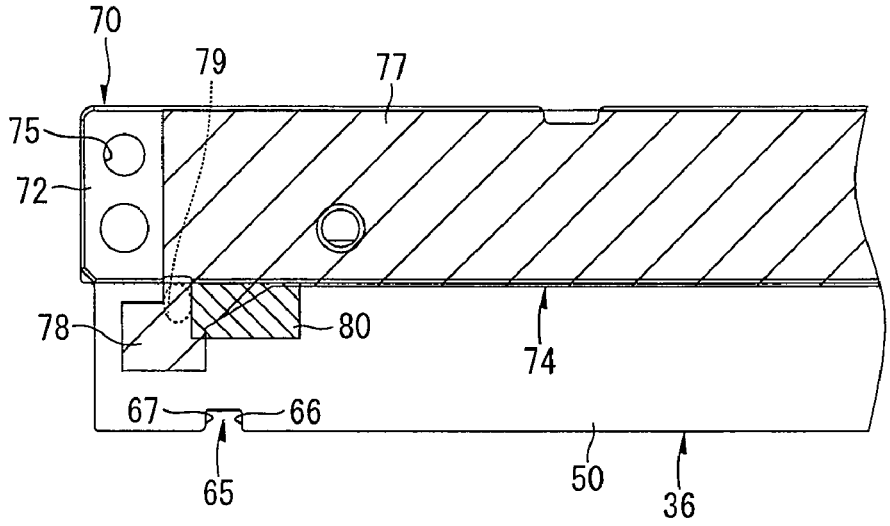
FIG. 7 is an illustrative front view for describing a positional relation of an upper seal, grease and an internal seal shown in FIG. 5.

FIG. 7 is an illustrative front view for describing a relational position of the upper seal 74, the grease 79 and the internal seal 80 (as seen from the back surface of the leaf spring member 50). In this FIG. 7, the upper seal 74 and the internal seal 80 are each indicated by hatching with different direction.

The internal seal 80 is formed in a generally rectangular shape as seen from front. The length of this internal seal 80 in the up-and-down direction is, for example, longer than the up-and-down length of the region on the back surface of the leaf spring member 50 to which the grease 79 adheres but shorter than the length of the blade opposed portion 78 of the upper seal 74 in the up-and-down direction. The internal seal 80 is disposed at the position laterally inward of the region on the back surface of the leaf spring member 50 to which the grease 79 adheres, in the state where the upper end edge thereof closely adheres along the lower end edge of the back-side member 72 of the blade holder 70. In addition, the external end edge of the internal seal 80 in the width direction is disposed at a position laterally outward of the laterally internal end edge which extends in the up-and-down direction of the blade opposed portion 78, in other words, is disposed at a position laterally outward of the straight line which extends in the up-and-down direction along the external end edge 67 of the notched portion 65.

3. Toner Empty Detection Mechanism

Figure 8:
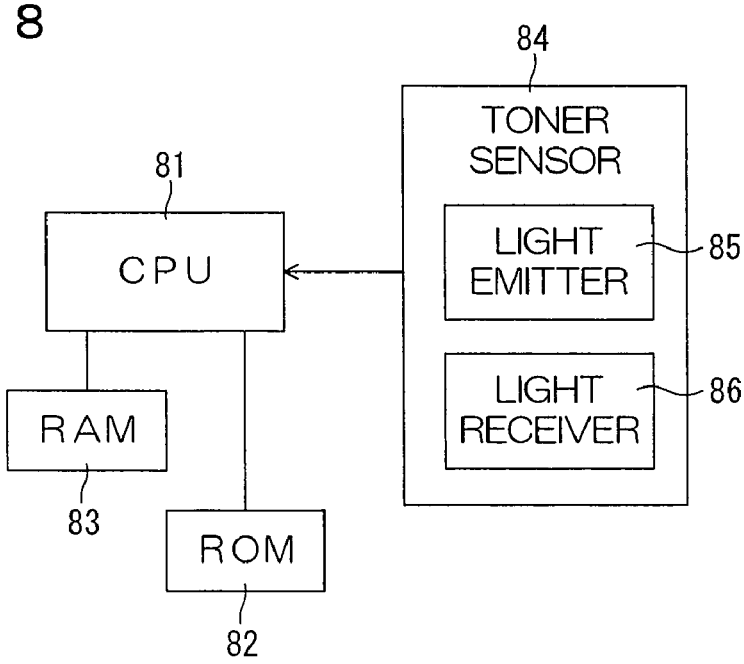
FIG. 8 is a block diagram showing a configuration for detecting a toner-empty state.

FIG. 8 is a block diagram showing a configuration for detecting an empty state of the toner accommodated in the toner accommodation chamber 40 in the casing 33 of the developer cartridge 29.

This laser printer 1 includes a CPU 81, a ROM 82, and a RAM 83.

The CPU 81 is connected with a toner sensor 84 as one example of an empty detection mechanism. The toner sensor 84 includes a pair of a light emitter 85 and a light receiver 86. The light emitter 85 is opposed to the window 42 disposed on one side wall 41 of the casing 33 of the developer cartridge 29 from the lateral outside. The light receiver 86 is opposed to the window 42 disposed on the other side wall 41 from the lateral outside. A strong light having high directivity emitted from the light emitter 85 enters through the window 42 in the casing 33. Then, the light passes the casing 33 in the width direction and enters in the light receiver 86 through the window 42. The light receiver 86 photoelectrically converts the entering light and outputs a voltage corresponding to the quantity of the light.

The CPU 81 executes the program stored in the ROM 82 and detects the empty state of the toner accommodated in the toner accommodation chamber 40 in the casing 33 on the basis of the change in the voltage outputted from the light receiver 86 of the toner sensor 84. At this time, the CPU 81 uses the RAM 83 as a work area.

Specifically, in the case where the larger the quantity of the light received at the light receiver 86 of the toner sensor 84 becomes, the lower the voltage which the light receiver 86 generates becomes, the CPU 81 recognizes the output signal of the light receiver 86 as a low level signal when the voltage outputted from the light receiver 86 is not higher than a predetermined threshold value. On the other hand, the CPU 81 recognizes the output signal of the light receiver 86 as a high level signal when the voltage outputted from the light receiver 86 is higher than the predetermined threshold value. In a state where a sufficient quantity of the toner remains in the toner accommodation chamber 40, since the light emitted from the light emitter 85 is blocked by the toner, the high level signal is outputted continuously from the light receiver 86. With repeated image formation operations, when the residual quantity of the toner in the toner accommodation chamber 40 is reduced, the light emitted from the light emitter 85 is blocked only when the toner that remains in the toner accommodation chamber 40 is agitated by the agitator 44. Therefore, the high level signal and the low level signal are outputted alternatively from the light receiver 86. At this time, the more the quantity of the toner remaining therein becomes, the longer the time during which the toner agitated by the agitator 44 floats in the toner accommodation chamber 40 becomes, and accordingly the longer the time during which the light emitted from the light emitter 85 is blocked by the toner becomes. Therefore, in this case, the ratio of the high level signal to the low level signal is higher. On the contrary, the smaller the quantity of the toner remaining therein becomes, the shorter the time during which the toner agitated by the agitator 44 floats in the toner accommodation chamber 40 becomes, and accordingly the shorter the time during which the light emitted from the light emitter 85 is blocked by the toner becomes. Therefore, in this case, the ratio of the high level signal to the low-level signal becomes lower. In response to the change that the ratio of the high level signal to the low level signal becomes lower than the predetermined ratio, the CPU 81 judges the toner empty state where the toner remaining in the toner accommodation chamber 40 is small.

4. Operations and Effects

As described hereinabove, the grease 79 is applied to fill the gap among the leaf spring member 50 of the layer-thickness regulating blade 36, the back-side member 72 of the blade holder 70, and the blade opposed portion 78 of the upper seal 74, thereby preventing the toner leakage from the gap.

In addition, since the internal seal 80 is disposed laterally inward of the grease 79 in a state where a portion thereof is sandwiched between the back surface of the leaf spring member 50 and the blade opposed portion 78 of the upper seal 74, the grease 79 can be prevented from overflowing inward in the width direction from the gap among the back-side member 72, the leaf spring member 50, and the upper seal 74. Further, the toner can be prevented from entering into the gap among the back-side member 72, the leaf spring member 50, and the upper seal 74. The oil content of the grease 79 is prevented from mixing into the toner.

Furthermore, since the internal seal 80 is disposed so as to closely adhere along the lower end edge of the back-side member 72 of the blade holder 70, the grease 79 can be prevented from overflowing from the interface between the internal seal 80 and the back-side member 72, and further, the toner can be prevented from entering the interface between the internal seal 80 and the back-side member 72. The oil content of the grease 79 is effectively prevented from mixing into the toner.

In addition, since the internal seal 80 extends downward beyond the contact region of the grease 79 on the back surface of the leaf spring member 50, the grease 79 can be prevented from entering the lower side of the internal seal 80 and overflowing laterally inward of the internal seal 80. The oil content of the grease 79 is more effectively prevented from mixing into the toner.

Moreover, since the notched portion 65 is formed on each of the both lateral end portions of the lower end portion of the leaf spring member 50, the toner scraped by the layer-thickness regulating blade 36 from the circumferential surface of the developing roller 35 passes mainly through the notched portion 65 and enters onto the back surface of the leaf spring member 50. In this developer cartridge 29, the grease 79 is disposed laterally outward of the notched portion 65, and therefore, the toner entering from the notched portion 65 onto the back surface of the leaf spring member 50 will not easily arrive at a position where the grease 79 is applied. The oil content of the grease 79 is more effectively prevented from mixing into the toner.

In addition, since the external end edge of the internal seal 80 in the width direction is disposed laterally outward of the external end edge 67 of the notched portion 65 in the width direction, the toner flowing from the notched portion 65 to the grease 79 can be effectively stopped by the internal seal 80. The oil content of the grease 79 is much more effectively prevented from mixing into the toner.

As a result, in the processing unit 20 and the laser printer 1 that include the developer cartridge 29, the oil content of the grease 79 can be much more effectively prevented from mixing into the toner.

Moreover, this laser printer 1 includes the toner sensor 84. In the laser printer 1, the empty state of the toner accommodated in the toner accommodation chamber 40 in the casing 33 of the developer cartridge 29 is detected on the basis of the ratio of the high level signal to the low level signal both of which are output from this toner sensor 84 (light receiver 86). Specifically, when the residual quantity of the toner in the toner accommodation chamber 40 is reduced, the time during which the toner floats in the toner accommodation chamber 40 when the toner is agitated by the agitator 44 is shortened. Therefore, the ratio of the high level signal to the low-level signal outputted from the toner sensor 84 becomes lower. In response to the change that the ratio of the high level signal to the low-level signal is lower than the predetermined ratio, the CPU 81 judges the empty state where the toner remaining in the toner accommodation chamber 40 is small.

However, the accuracy of detecting the toner-empty state depends greatly on the fluidity of the toner remaining in the toner accommodation chamber 40. For example, when the fluidity of the toner is lowered, the time the toner floats in the toner accommodation chamber 40 when the toner is agitated by the agitator 44 is shortened, which causes the CPU 81 to determine that the toner is in the empty state even when the toner remains in the toner accommodation chamber 40 in some degree and should not be judged as the toner-empty state.

This laser printer 1 includes the developer cartridge 29 which can prevent the oil content of the grease 79 from mixing into the toner, and thus can prevent the reduction in the fluidity of the toner caused by the mixing of the oil content of the grease 79 into the toner. Accordingly, the toner-empty state can be accurately detected.

5. Modifications (1) Modification of Position of Internal Seal

Figure 9:
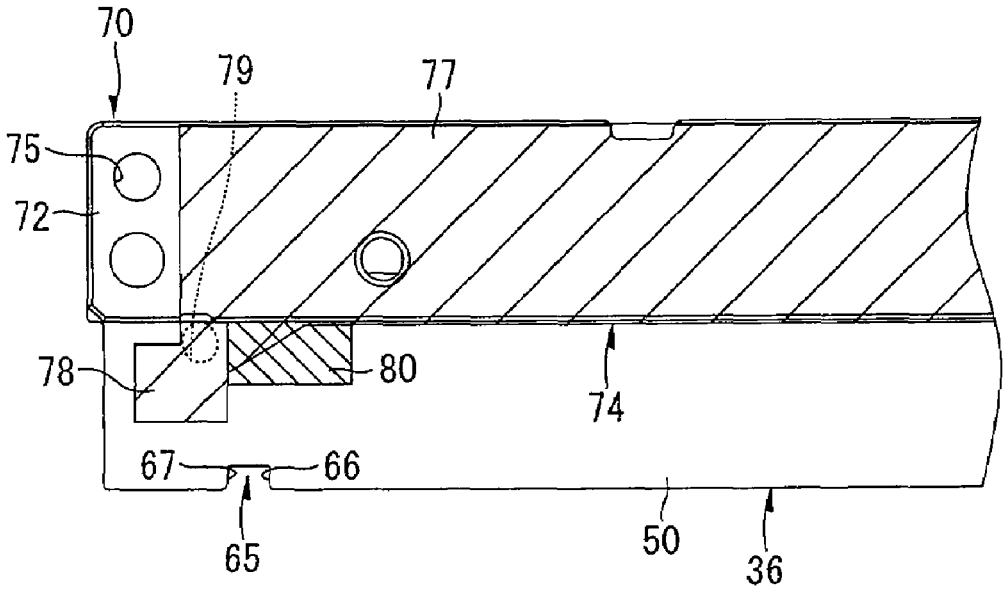
FIG. 9 is a front view for describing a modification of a position of the internal seal.

FIG. 9 is a front view for describing a modification of a position of the internal seal 80 (as seen from the back surface side of the leaf spring member 50). In this FIG. 9, the portion corresponding to each aforementioned element will be provided with the same reference numeral. Each element with the same reference numeral will not be described hereinafter in detail. Moreover, the upper seal 74 and the internal seal 80 are each indicated by hatching with different direction.

In the configuration shown in FIG. 7, the external end edge of the internal seal 80 in the width direction is disposed at a position laterally outward of the straight line extending in the up-and-down direction along the external end edge 67 of the notched portion 65. However, as shown in FIG. 9, the external end edge of the internal seal 80 in the width direction can be disposed on the straight line extending in the up-and-down direction along the external end edge 67 of the notched portion 65.

(2) Modification of Shape of Internal Seal

Figure 10:
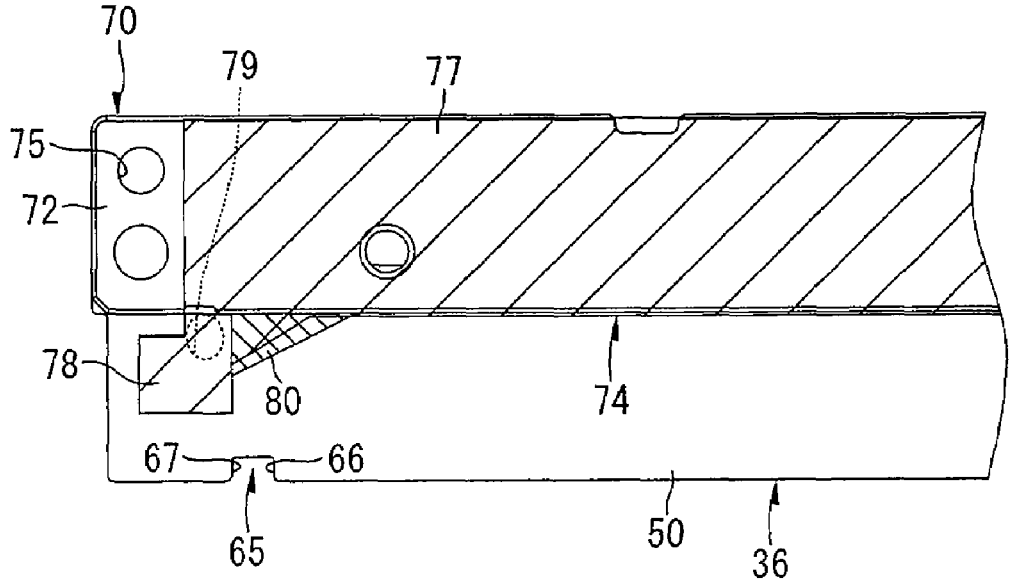
FIG. 10 is a front view for describing a modification of shape of the internal seal.

FIG. 10 is a front view for describing a modification of the shape of the internal seal 80 (as seen from the back surface side of the leaf spring member 50.). In this FIG. 10, the portion corresponding to each aforementioned element will be provided with the same reference numeral. Each element with the same reference numeral will not be described hereinafter in detail. Moreover, the upper seal 74 and the internal seal 80 are each indicated by hatching with different direction.

In the configuration shown in FIG. 7, the internal seal 80 is formed in a generally rectangular shape as seen from front. However, it may be formed in a generally right triangle as seen from front having an external end edge in the width direction extending in the up-and-down direction, as shown in FIG. 10.

In this case, the external end edge of the internal seal 80 in the width direction may be disposed on the straight line extending in the up-and-down direction along the external end edge 67 of the notched portion 65, as shown in FIG. 10, or may be disposed at a position laterally outward of the straight line.

(3) Other Modifications

In the embodiment and the modifications described above, the internal end edge of the internal seal 80 in the width direction is disposed laterally inward of the straight line extending in the up-and-down direction along the internal end edge 66 of the notched portion 65. However, in the case where a sufficient space exists between the straight line and the external end edge of the blade opposed portion 78 of the upper seal 74 in the width direction, the internal end edge of the internal seal 80 in the width direction may be disposed laterally outward of the straight line.

As an image forming apparatus, the laser printer 1 including the processing unit 20, in which the developer cartridge 29 is detachably attached to the drum cartridge 28, has been illustrated. However, the image forming apparatus is not limited thereto. The image forming apparatus may be, for example, a laser printer in which the photosensitive drum 30 is provided in the main body casing 2 and which includes the developer cartridge 29 directly attached to and detached from the main body casing 2. Alternatively, the image forming apparatus is not limited to the black and white laser printer described above, and may be a color laser printer of various types (four-cycle type, tandem intermediate transfer type, tandem direct transfer type, and the like).

The embodiments described above are illustrative and explanatory of the invention. The foregoing disclosure is not intended to be precisely followed to limit the present invention. Various modifications and alterations are possible in light of the foregoing description, and may be obtained by implementing the invention. The present embodiments are selected and described for explaining the essence and practical applicational schemes of the present invention which allow those skilled in the art to utilize the present invention in various embodiments and various alterations suitable for anticipated specific use. The scope of the present invention is to be defined by the appended claims and their equivalents.

What is claimed is:

1. A developing device including:

a casing formed with an elongated opening and having a wall portion along one end edge extending in a longitudinal direction of the opening;

a developing agent carrier member for carrying a developing agent on a circumferential surface, disposed so as to expose one portion of the circumferential surface from the opening and provided rotatably about an axis extending in the longitudinal direction;

a layer-thickness regulating member for restricting a layer thickness of the developing agent carried on the circumferential surface, formed in a thin plate shape extending in the longitudinal direction and having one distal end portion on one end side in a direction orthogonal to the longitudinal direction for pressing the circumferential surface of the developing agent carrier member;

a holding member for holding a proximal end portion on the opposite side of the distal end portion of the layer-thickness regulating member, disposed in an opposed relation to the wall portion;

a first seal member for sealing between the wall portion and the holding member, which extends in the longitudinal direction, each of whose both end portions in the longitudinal direction is sandwiched between the wall portion and the holding member and between the wall portion and the layer-thickness regulating member, and in which a central portion between the both end portions is sandwiched at least between the wall portion and the holding member;

an oil filler for filling the gap, disposed in a gap formed among the layer-thickness regulating member, the holding member and each of the both end portions of the first seal member; and a second seal member provided partially in a region inward in the longitudinal direction with respect to the oil filler on a opposed surface of the layer-thickness regulating member to the first seal member with at least a portion thereof disposed in a state of being sandwiched between the layer-thickness regulating member and the first seal member.

2. The developing device according to claim 1, wherein the second seal member is disposed so as to closely adhere to the holding member.

3. The developing device according to claim 1, wherein the second seal member extends to a position closer to the distal end portion of the layer-thickness regulating member than a contact region of the oil filler in the layer-thickness regulating member.

4. The developing device according to claim 1, wherein the layer-thickness regulating member has a notched portion on each of both end portions of the distal end portion thereof in the longitudinal direction, and the oil filler is disposed at a position outward of the notched portion in the longitudinal direction.

5. The developing device according to claim 4, wherein the second seal member has an external end edge in the longitudinal direction disposed on a line of an external end edge of the notched portion in the longitudinal direction or outward of the line in the longitudinal direction.

6. A processing cartridge comprising:

a developing device; and an image carrier member fed with a developing agent from the developing device, wherein the developing device comprises:

a casing formed with an elongated opening and having a wall portion along one end edge extending in a longitudinal direction of the opening;

a developing agent carrier member for carrying a developing agent on a circumferential surface, disposed so as to expose one portion of the circumferential surface from the opening and provided rotatably about an axis extending in the longitudinal direction;

a layer-thickness regulating member for restricting a layer thickness of the developing agent carried on the circumferential surface, formed in a thin plate shape extending in the longitudinal direction and having one distal end portion on one end side in a direction orthogonal to the longitudinal direction for pressing the circumferential surface of the developing agent carrier member;

a holding member for holding a proximal end portion on the opposite side of the distal end portion of the layer-thickness regulating member, disposed in an opposed relation to the wall portion;

a first seal member for sealing between the wall portion and the holding member, which extends in the longitudinal direction, each of whose both end portions in the longitudinal direction is sandwiched between the wall portion and the holding member and between the wall portion and the layer-thickness regulating member, and in which a central portion between the both end portions is sandwiched at least between the wall portion and the holding member;

an oil filler for filling the gap, disposed in a gap formed among the layer-thickness regulating member, the holding member and each of the both end portions of the first seal member; and a second seal member provided partially in a region inward in the longitudinal direction with respect to the oil filler on a opposed surface of the layer-thickness regulating member to the first seal member with at least a portion thereof disposed in a state of being sandwiched between the layer-thickness regulating member and the first seal member.

7. An image forming apparatus comprising:

a developing device; and an image carrier member fed with a developing agent from the developing device, wherein the developing device comprises:

a casing formed with an elongated opening and having a wall portion along one end edge extending in a longitudinal direction of the opening;

a developing agent carrier member for carrying a developing agent on a circumferential surface, disposed so as to expose one portion of the circumferential surface from the opening and provided rotatably about an axis extending in the longitudinal direction;

a layer-thickness regulating member for restricting a layer thickness of the developing agent carried on the circumferential surface, formed in a thin plate shape extending in the longitudinal direction and having one distal end portion on one end side in a direction orthogonal to the longitudinal direction for pressing the circumferential surface of the developing agent carrier member;

a holding member for holding a proximal end portion on the opposite side of the distal end portion of the layer-thickness regulating member, disposed in an opposed relation to the wall portion;

a first seal member for sealing between the wall portion and the holding member, which extends in the longitudinal direction, each of whose both end portions in the longitudinal direction is sandwiched between the wall portion and the holding member and between the wall portion and the layer-thickness regulating member, and in which a central portion between the both end portions is sandwiched at least between the wall portion and the holding member;

an oil filler for filling the gap, disposed in a gap formed among the layer-thickness regulating member, the holding member and each of the both end portions of the first seal member; and a second seal member provided partially in a region inward in the longitudinal direction with respect to the oil filler on a opposed surface of the layer-thickness regulating member to the first seal member with at least a portion thereof disposed in a state of being sandwiched between the layer-thickness regulating member and the first seal member.

8. The image forming apparatus according to claim 7, wherein the casing accommodates the developing agent, and an empty-state detection mechanism is provided for detecting an empty-state of the developing agent in the casing on a basis of a residual quantity and a fluidity of the developing agent accommodated in the casing.

* * * * *